United States Patent [19]

Mitarai

[11] Patent Number: 4,463,646

[45] Date of Patent: Aug. 7, 1984

[54] POWER SAVING APPARATUS FOR ELECTRONIC MUSICAL INSTRUMENT

[75] Inventor: Tsuyoshi Mitarai, Yokohama, Japan

[73] Assignee: Casio Computer Co., Ltd., Tokyo, Japan

[21] Appl. No.: 409,283

[22] Filed: Aug. 18, 1982

[30] Foreign Application Priority Data

Aug. 21, 1981 [JP] Japan ..... 56-130877

[51] Int. Cl.[3] ..... G10H 1/00

[52] U.S. Cl. ..... 84/1.01; 307/31; 364/707

[58] Field of Search ..... 84/1.01; 307/31, 35; 364/707

[56] References Cited

U.S. PATENT DOCUMENTS 4,321,851 3/1982 Adachi ..... 84/1.01
4,419,917 12/1983 Sato ..... 84/1.01

FOREIGN PATENT DOCUMENTS 3034562 9/1979 Fed. Rep. of Germany .
50-50026 5/1975 Japan .
56-40895 4/1981 Japan .

*Primary Examiner*—S. J. Witkowski
*Attorney, Agent, or Firm*—Frishauf, Holtz, Goodman & Woodward

[57] ABSTRACT

A CPU provides control instructions according to key switch information supplied from a keyboard. An LSI receives the control instructions and generates a corresponding digital tone signal, which is converted in an acoustic system into an analog tone signal which is in turn supplied to a loudspeaker for producing sound. A power supply unit can be connected to the LSI and acoustic system through a transistor. The transistor is on-off controlled according to a power-off signal which is provided from the CPU according to a silent state signal generated from a power saving circuit in the LSI.

7 Claims, 4 Drawing Figures

POWER SAVING APPARATUS FOR ELECTRONIC MUSICAL INSTRUMENT

BACKGROUND OF THE INVENTION

This invention relates to a power saving apparatus for an electronic musical instrument for digitally producing musical tones.

Recently, electronic musical instruments have become very popular. In particular, compact electronic musical instruments which use LSIs (large scale integrated circuits) for tone generating circuits and are powered by batteries, have been developed.

In the usual battery-powered electronic musical instrument, power is inefficiently consumed if a power switch of the instrument is held "on". If the instrument is left with the power switch held "on", the battery is soon used up, and the battery must be replaced frequently. This is not only inconvenient but is also uneconomical. Such inefficient power consumption is also the case with an electronic musical instrument which is powered by a commercial power source.

Accordingly, there has been developed an electronic musical instrument, in which the power source is turned "off" automatically when the power source switch has been held "on" without the instrument being played for a predetermined period of time. For example, this is disclosed in Japanese patent disclosure (KOKAI) No. 56-40895 or in a U.S. patent application Ser. No. 185,411 filed Sept. 9, 1980, assigned to the assignee of the present invention and now abandoned. In this case, however, if the predetermined period of time is too short, the player must always bear in mind whether power is being supplied while playing. On the other hand, if the predetermined period of time is too long, a considerable amount of power is wasted if the instrument is left with the power switch held "on". In either case, the power source is held "on" until the predetermined period of time has elapsed, and power consumed during this period is often wasted.

SUMMARY OF THE INVENTION

An object of the invention is to provide a power saving apparatus for an electronic musical instrument, regardless of the mode of use of the instrument or the number of musical operations performed, in which power can be saved during the instrument's silent state (when no tone is generated), and such that as soon as a performance key is operated, a tone signal generating circuit is driven to generate a tone corresponding to the operated key without the need of operating a power switch.

According to the present invention, the above object is attained with a power saving apparatus for an electronic musical instrument which comprises a power supply unit, a control unit furnished with power from the power supply unit, a tone information generating unit for generating tone information about a tone generating operation according to a scan signal generated from the control unit and supplying the tone information to the control unit, a tone generating circuit for receiving signals corresponding to the tone information from the control unit and generating a corresponding digital tone signal, an acoustic system for generating an analog tone signal corresponding to the digital tone signal and supplying the analog tone signal to a loudspeaker, power supply control means coupled to the control unit and connected to the power source unit, for controlling power supply to the tone generating circuit and acoustic system, and means for supplying a soundless or silent state signal to the control unit when detecting operation of the tone generating circuit in the absence of the signals corresponding to the tone information from the control unit, wherein the control unit controls the power supply control means according to the silent state signal.

DETAILED DESCRIPTION OF THE PREFERRED EMBODIMENTS

Figure 1:
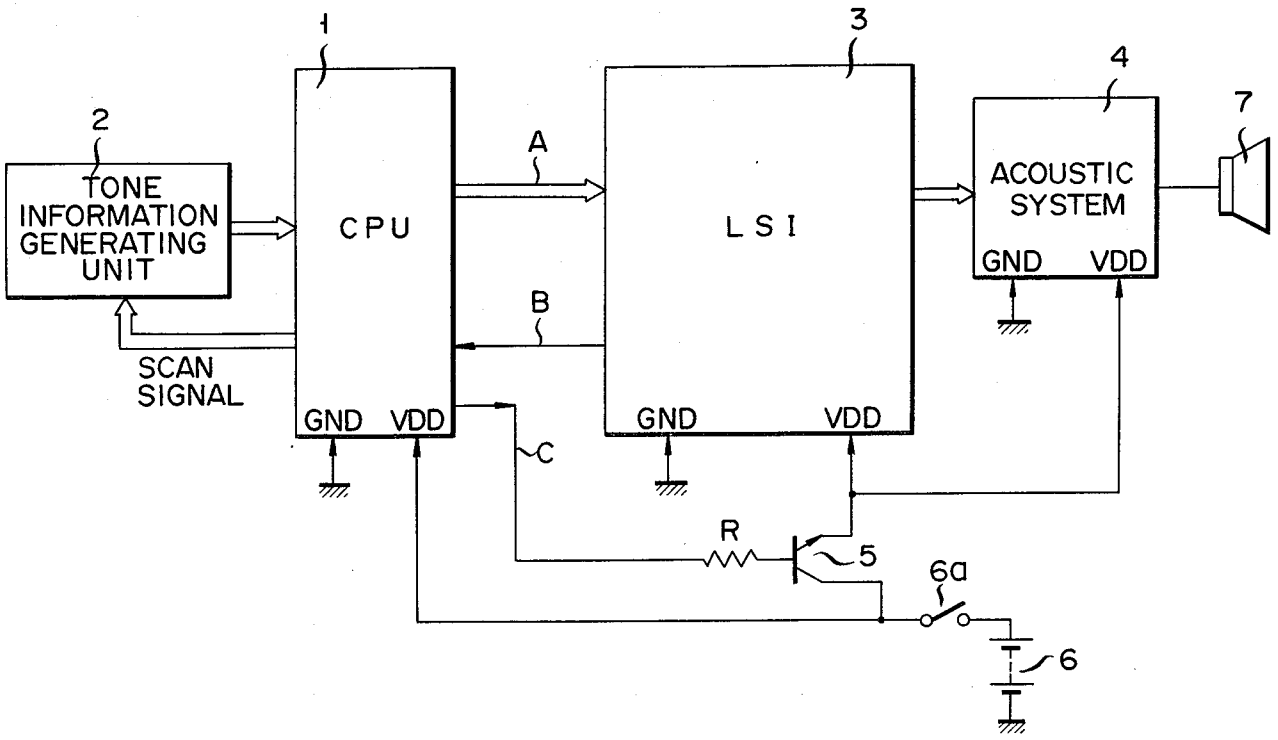
FIG. 1 is a block diagram showing an embodiment of the power saving apparatus according to the invention.
Figure 2:
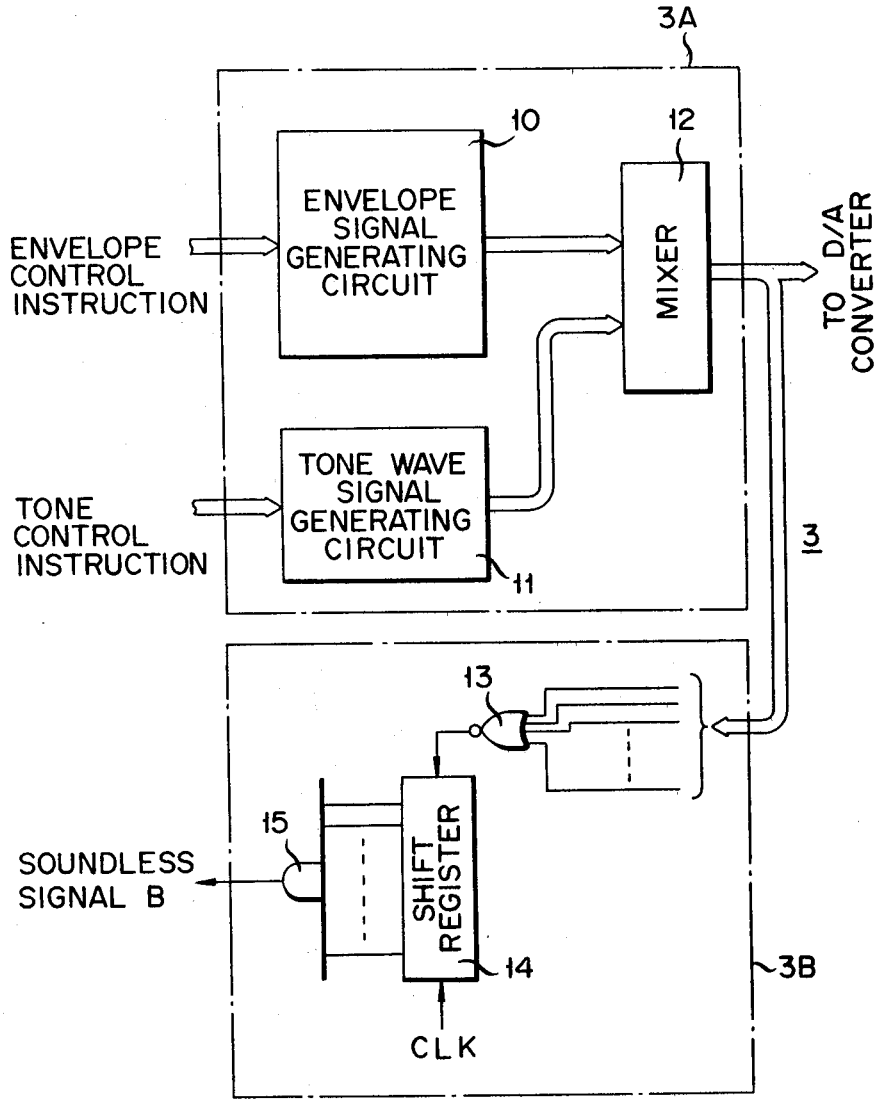
FIG. 2 is a block diagram showing the internal construction of an LSI shown in FIG. 1.

FIGS. 1 and 2 show a first embodiment of the invention. Referring to FIG. 1, a CPU (central processing unit) 1 is a circuit which controls the whole operation of the electronic musical instrument. The CPU is well known and its details are not described. To the CPU 1 is supplied key switch information (i.e., tone information) from a tone information generating unit 2, i.e., the keyboard in this case, according to a scan signal provided from the CPU 1. Control instructions A such as an envelope control instruction and a tone control instruction (these instructions being necessary for generating tones of operated keys) are provided from the CPU 1 to an LSI (large scale integrated circuit) 3. As shown in FIG. 2, the LSI 3 includes a tone signal generating circuit 3A and a power saving circuit 3B. The LSI 3 generates a digital tone signal according to the control instructions. This digital tone signal is supplied to an acoustic system 4. Also, when a soundless or silent state in which no tone is generated continues for a predetermined period of time, the LSI 3 detects this and provides a soundless detection signal (i.e., silent state signal B) to the CPU 1. The CPU 1 produces a power-off signal C in response to the silent state signal B. The power-off signal C is coupled through a resistor R to the base terminal of an npn transistor 5. The collector terminal of the transistor 5 is connected through a power switch 6a to the positive side terminal of a battery 6. The emitter terminal of the transistor 5 is connected to a power supply terminal $V_{DD}$ of the LSI 3 and also to a power supply terminal $V_{DD}$ of the acoustic system 4. The positive side terminal of the battery 6 is also connected to a power supply terminal $V_{DD}$ of the CPU 1. A ground terminal GND of the CPU 1, LSI 3 and acoustic system 4 and the negative terminal of the battery 6 are grounded.

Each time the silent state is detected, the power-off signal C is supplied as a "0" level signal, and as soon as the key-on state is detected it is restored to a "1" level. The transistor 5, and hence the battery 6 as power supply, is turned off when the power-off signal C goes to the "0" level while it is turned on when the power-off signal C goes to the "1" level.

The acoustic system 4 has a D/A (digital/analog) converter and an amplifier, and it converts the digital tone signal output from the LSI 3 into an analog tone signal and amplifies the same. The output of the acoustic system 4 is supplied to a loudspeaker 7 to produce sound.

The contruction of the LSI 3 will now be described in detail with reference to FIG. 2. The tone generating circuit 3A includes an envelope signal generating circuit 10, a tone wave signal generating circuit 11 and a mixer 12. The envelope control instruction from the CPU 1 is supplied to the envelope signal generating circuit 10. According to this instruction the circuit 10 produces an envelope signal including attack, decay, sustain and release portions. The envelope signal is supplied to the mixer 12. The tone control instruction from the CPU 1 is supplied to the tone wave signal generating circuit 11. According to this instruction the circuit 11 produces a tone wave signal at a corresponding frequency. The tone wave signal is also supplied to the mixer 12. The mixer 12 includes a multiplier, which multiplies the envelope signal and tone wave signal by each other. The product output is supplied to the D/A converter. For the LSI 3, the one disclosed in U.S. Pat. No. 3,515,792 issued on June 2, 1970 may be used.

The power saving circuit 3B includes a NOR gate 13, a shift register 14 and an AND gate 15. The product output of the mixer 12 is supplied to the NOR gate 13, and the output thereof is supplied to a leading bit position of the shift register 14. The shift register 14 is driven by a sampling clock CLK from a clock generator, not shown, provided in the LSI 3. It has a bit capacity necessary to detect the silent state for the predetermined period of time mentioned above. All "0" data is produced from the mixer 12 also when the tone wave crosses the zero point. For this reason, the silent state is detected as such when the all "0" data has continued for a plurality of sampling clock cycle periods. The individual bit outputs of the shift register 14 are supplied to an AND gate 15, and the output thereof is supplied as the silent state signal B.

The operation of the first embodiment will now be described with reference to FIG. 4. While the musical instrument is played with the power switch 6a "on", the key switch information from the keyboard 2 is supplied to the CPU 1 so that the CPU 1 provides control instructions A (such as envelope control instruction and tone control instruction) to the envelope signal generating circuit 10 and tone wave signal generating circuit 11 in the LSI 3. Thus, the envelope signal generating circuit 10 produces an envelope signal according to the depression and release of each operated key, while the tone wave signal generating circuit 11 produces a tone wave signal at a corresponding frequency. These signals are supplied to the mixer 12. The mixer 12 combines the envelope signal and tone wave signal and supplies the resultant product output to the D/A converter in the acoustic system 4 and also to the NOR gate 13 in the power saving circuit 3B. The D/A converter converts the input signal into an analog signal which is amplified by the amplifier therein. The tone signal of the amplified analog quantity is supplied to the loudspeaker 7 to produce corresponding sound. The period, during which the operation described above takes place, may be shown as a "DATA I" period in (a) in FIG. 4. After the release of the operated key, the product output of the mixer 12 does not become all "0" data until the envelope signal becomes all "0" data. In the foregoing state, the output of the NOR gate 13 in the power saving circuit 3B is "0" so that all the bit outputs of the shift register 14 are "0". Thus, the output of the AND gate 15, i.e., the silent state signal B is "0". This silent signal B is supplied to the CPU 1. Thus, the power-off signal C at the "1" level is provided from the CPU 1 to hold the transistor 5 "on". During this time, the apparatus maintains the "power on" state, with the battery 6 connected to the power supply terminals $V_{DD}$ of the LSI 3 and acoustic system 4.

Figure 4:
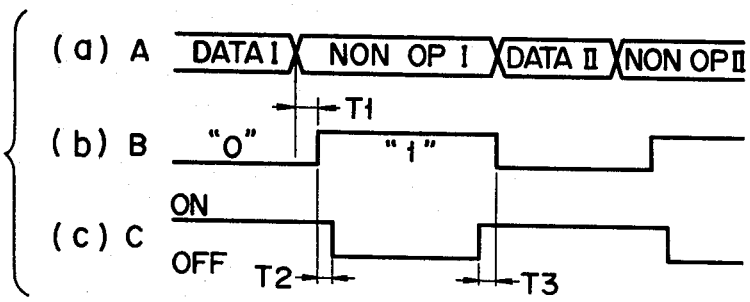
FIG. 4 is a time chart for explaining the operation of the embodiments of FIGS. 1 to 3.

In FIG. 4, the periods shown as DATA are periods during which the control instructions A are supplied from the CPU 1 to the LSI 3, and the other periods are NON OPERATION periods.

When an operated key is released ( or a plurality of simultaneously operated keys are all released), the envelope signal subsequently crosses the zero axis and becomes all "0" provided no key is subsequently operated. From this instant of zero-crossing, the output of the NOR gate 13, and hence the leading bit input to the shift register 14, becomes "1". However, the output of the AND gate 15 remains "0" until the sampling clock CLK corresponding to the bit capacity of the shift register 15 is subsequently provided. That is, at this time the silent state signal B is still "0". When all the output bits of the shift register 14 become "1", the output of the AND gate 15, i.e., the silent state signal B, becomes "1". The period from the end of the control instructions A (i.e., end of the DATA I period) until the instant when the silent state signal B becomes "1", as shown at T1, is determined by the sustain and release periods of the envelope and also the bit capacity of the shift register 15. After a slight delay time T2 from the change of the silent state signal B to "1", the CPU 1 reverts the power-off signal C to the "0" level to turn off the transistor 5. As a result, the battery 6 is disconnected from the LSI 3 and acoustic system 4 to bring about the "power off" state.

Subsequently, the CPU 1 naturally provides no control instructions A for generating any tone. This period subsequent to the DATA I period is shown as a NON-OPERATION I period in (a) in FIG. 4.

When a key in the unit 2 is depressed in the silent state, key switch information is supplied to the CPU 1 according to the scan signal therefrom. As a result, the CPU 1 inverts the power-off signal C to the "1" level to turn on the transistor 5. That is, as soon as the key is depressed, the power supply is connected to the LSI 3 and acoustic system 4, and after a predetermined delay time T3 control instruction A (DATA II) for generating the corresponding tone are provided from the CPU 1. Thus, the operation of generating the tone corresponding to the operated key is begun, changing the output of the mixer 12 from the all "0" data, thus changing the output of the NOR gate 13 to "0". Substantially simultaneously with the start of the DATA II period, the silent state signal B is reverted to the "0" level (see FIG. 4).

Then, after the output of the mixer 12 becomes all "0" data again, the silent state is detected to initiate the "power off" state. Also, as soon as any other key is depressed, the "power on" state is again set to start the tone generating operation.

Figure 3:
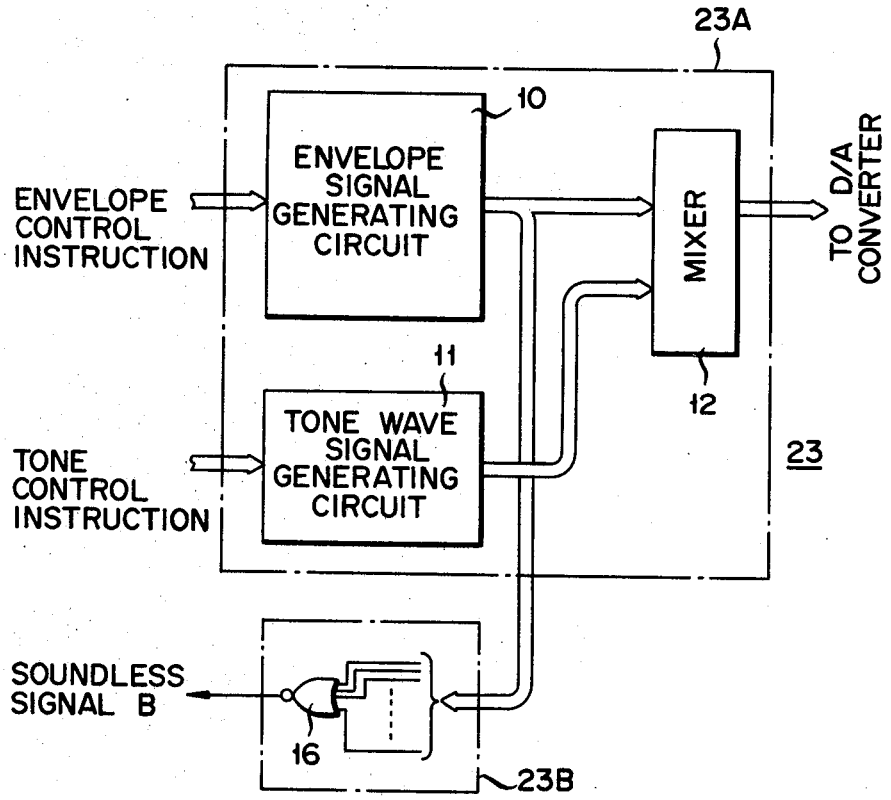
FIG. 3 is a block diagram showing the internal construction of an LSI in a different embodiment of the invention.

FIG. 3 shows an LSI 23 in a second embodiment. In this embodiment, the power saving circuit 23B detects that the envelope signal in the tone signal generating circuit 23A has become all "0" state, i.e., the silent state, and produces the silent state signal B. The circuit construction of this embodiment is the same as the preceding first embodiment except in that the power saving circuit 23B is different. The same parts as those in the first embodiment are designated by like reference numerals and are not described any further.

The envelope signal from the envelope signal generating circuit 10 is supplied to the NOR gate 16 in the power saving circuit 23B, and the output of the NOR gate 16 is supplied as the silent state signal B to the CPU 1.

After the key is released, at the end of the release period the envelope signal becomes all "0" data. At this instant, the silent signal B is changed to the "1" level. In the case of FIG. 3, since the shift register 14 in FIG. 2 is absent, the CPU 1 can change the power-off signal C to the "0" level to set the "power off" state that much sooner. Thus, the power saving effect can be improved.

The operation of the second embodiment is similar to the operation of the first embodiment as described earlier in connection with the time chart of FIG. 4.

In the above embodiments, tones corresponding to a plurality of simultaneously operated keys can be generated by processing on a time division basis. In the case of the first embodiment, cumulative data of the individual time division channels may be obtained in the mixer 12 and supplied to the NOR gate 13. In the second embodiment, the envelope data of the individual channels may be accumulated, and the result may be supplied to the NOR gate 16.

Further, in a case where a plurality of tone signal generating circuits 3A or 23A in the first or second embodiment are provided to permit chord performance, the silent state signal may be controlled according to the result of accumulation of the outputs of the mixer 12 or envelope signal generating circuit 10 in the individual tone signal generating circuits.

Further, where the LSI consists of C-MOS transistors, a clock oscillator in the LSI may be adapted to be stopped in response to the inversion of the silent state signal B to "1", thereby stopping the clock for driving the individual circuits to bring out in effect the "power off" state.

Furthermore, the invention is applicable to a musical instrument without a keyboard and also to a musical instrument which can provide for an automatic performance of a number preset in a memory.

Various further changes and modifications are possible without departing from the scope and spirit of the invention.

As has been described in the foregoing, with the power saving apparatus for an electronic musical instrument according to this invention, the power supply is cut off except for the power supply to a control unit in response to the detection of a silent state signal produced in the absence of any tone being generated for sound production. Wasteful power consumption while the instrument is not played can be greatly reduced. Thus, particularly with an electronic musical instrument of the battery-driven type, the frequency of battery replacement can be reduced. This is desired not only from the standpoint of economy but also from the standpoint of the inconvenience caused when the battery is replaced. Further, the circuit construction is simple and leads to no significant cost increase at all.

What is claimed is:

1. A power saving apparatus for an electronic musical instrument, comprising:

a power supply unit;

a control unit arranged to be supplied with power from said power supply unit for providing signals to control operations in the instrument;

a tone information generating unit for generating tone information with respect to a tone generating operation in response to a scan signal generated from said control unit, and for supplying said tone information to said control unit wherein said control unit operates to produce control instruction signals corresponding to said tone information;

a tone generating circuit for receiving said control instruction signals from said control unit and for generating a corresponding digital tone signal;

an acoustic system for generating an analog tone signal corresponding to said digital tone signal;

a loudspeaker for generating a musical sound corresponding to said analog tone signal from said acoustic system;

power supply control means coupled to said control unit and connected between said power supply unit and said tone generating circuit, and between said power supply unit and said acoustic system, for controlling power supply to said tone generating circuit and to said acoustic system; and means coupled to said tone generating circuit for supplying a silent state signal to said control unit when said tone generating circuit operates in the absence of control instruction signals from said control unit, said power supply control means being controlled by said control unit according to said silent state signal.

2. The power saving apparatus according to claim 1, wherein said power supply control means includes a transistor having an emitter-collector current path connected between said power supply unit, and said tone generating circuit and said acoustic system.

3. The power saving apparatus according to any one of claims 1 and 2, wherein said tone generating circuit includes an envelope signal generating circuit for generating an envelope signal and a tone wave signal generating circuit for generating a tone wave signal according to the control instruction signals supplied from said control unit, and a mixer for generating a digital tone signal by combining the outputs of said generating circuit.

4. The power saving apparatus according to claim 3, wherein said silent state signal supplying means includes first gate means supplied with the output digital tone signal of the mixer in the tone generating circuit, a shift register having an input terminal supplied with an output of the first gate means, and second gate means for producing a logical product of respective bit outputs of the shift register, an output of the second gate means being supplied to the control unit as the silent state signal.

5. The power saving apparatus according to claim 3, wherein said silent state signal supplying means includes gate means to which the output envelope signal from said envelope signal generating circuit in said tone generating circuit is supplied, the output of said gate means being supplied as said silent state signal to said control unit.

6. A power saving means for an electronic musical instrument; comprising:

a power supply unit;

a control unit arranged to be supplied with power from said power supply unit for providing signals to control operations in the instrument;

a tone information generating unit for generating tone information with respect to a tone generating operation in response to a scan signal generated from said control unit, and for supplying said tone information to said control unit wherein said control unit operates to produce control instruction signals corresponding to said tone information;

a tone generating circuit arranged to be supplied with said control instruction signals by said control unit and for generating a corresponding digital tone signal;

a loudspeaker;

an acoustic system for generating an analog tone signal corresponding to said digital tone signal and for supplying said analog tone signal to said loudspeaker, and comprising a digital/analog converter arranged to be supplied with said digital tone signal;

power supply control means coupled to said control unit and connected between said power supply unit and said acoustic system, for controlling the power supply to said acoustic system, said power supply control means also being connected between said power supply unit and said tone generating circuit for controlling the power supply to said tone generating circuit; and silent state signal supplying means to which said digital tone signal is supplied, for supplying a silent state signal to said control unit when said tone generating circuit operates in the absence of control instruction signals from said control unit, said power supply control means being controlled by said control unit according to said silent state signal.

7. A power saving apparatus for an electronic musical instrument, comprising:

a power supply unit;

a control unit arranged to be supplied with power from said power supply unit for providing signals to control operations in the instrument;

a tone information generating unit for generating tone information with respect to a tone generating operation in response to a scan signal generated from said control unit, and for supplying said tone information to said control unit wherein said control unit operates to produce control instruction signals corresponding to said tone information;

tone generating circuit means arranged to be supplied with said control instruction signals by said control unit, including means for generating a digital tone wave signal, means for generating an envelope signal and means for superimposing said envelope signal on said digital tone wave signal, wherein a corresponding digital tone signal is generated by said tone generating circuit means;

a loudspeaker;

an acoustic system for generating an analog tone signal corresponding to said digital tone signal and for supplying said analog tone signal to said loudspeaker, and comprising a digital/analog converter arranged to be supplied with said digital tone signal;

power supply control means coupled to said control unit and connected between said power supply unit and said acoustic system, for controlling the power supply to said acoustic system, said power supply control means also being connected between said power supply unit and said tone generating circuit means for controlling the power supply to said tone generating circuit means; and silent state signal supplying means to which said envelope signal from said envelope signal generating means of said tone generating circuit means is supplied, for supplying a silent state signal to said control unit when said envelope signal generating means operates in the absence of control instruction signals from said control unit, said power supply control means being controlled by said control unit according to said silent state signal.

* * * * *